United States Patent [19]

Schilling et al.

[11] Patent Number: 4,708,065

[45] Date of Patent: Nov. 24, 1987

[54] FULL CALIBER TRAINING PROJECTILE

[75] Inventors: Hartmut Schilling, Kaarst; Helmuth Peller; Hansjoerg Becker, both of Duesseldorf, all of Fed. Rep. of Germany

[73] Assignee: Rheinmetall GmbH, Duesseldorf, Fed. Rep. of Germany

[21] Appl. No.: 709,507

[22] Filed: Mar. 8, 1985

[30] Foreign Application Priority Data

Mar. 8, 1984 [DE] Fed. Rep. of Germany ..... 3408476

[51] Int. Cl.[4] ..... F42B 9/20

[52] U.S. Cl. ..... 102/529; 102/501

[58] Field of Search ..... 102/439, 501–503, 102/514–517, 524, 529; 244/3.1

[56] References Cited

U.S. PATENT DOCUMENTS 326,231 9/1885 Manning ..... 102/501

694,675 3/1902 Scott ..... 102/439

3,873,048 3/1975 Platou ..... 244/3.1

4,549,487 10/1985 Jensen ..... 102/529

FOREIGN PATENT DOCUMENTS 523560 1/1980 U.S.S.R. ..... 102/501

OTHER PUBLICATIONS

"The American Rifleman", Jan. 1938, p. 45.

*Primary Examiner*—Harold J. Tudor

[57] ABSTRACT

A spin-stabilized training projectile provides a reliable reduction of a firing range by means of the special construction of a recess in the body of the projectile. The flight path of the training projectile is adaptable to the corresponding flight path of a corresponding live reference projectile over a distance in a predetermined region of the first portion of the flight path of the training projectile.

2 Claims, 2 Drawing Figures

FULL CALIBER TRAINING PROJECTILE

BACKGROUND OF THE INVENTION

The invention relates to a full caliber training projectile. Such projectile is known from German published patent application No. P 26 09 590. In this known training projectile a forward rotational symmetrical portion has an ogival shape and has a rearwardly axially extending cylindrical pin that adjoins the rotational-symmetrical front portion via a rearwardly facing annular smooth boundary surface. A ballast body is disposed rearwardly of the rotational-symmetrical front portion and the free end of the rearwardly extending pin extends into an axial central blind bore. The ballast body has a substantially full caliber dimension. The length of the rearwardly extending pin is larger than the depth of blind bore in the ballast body. The bolt has a larger exterior diameter in the forward portion thereof as compared to the region of its free end which extends into the blind bore. The interior diameter of the blind bore corresponds to the larger outer diameter in the forward region of the blind bore. In the rear region of the blind bore the inner diameter corresponds to the smaller exterior diameter of the rearwardly extending pin. In this manner, the rearwardly extending pin is firmly guided over a predetermined distance along the axis of the projectile. There is disposed a rubber elastic spring element between the rear annular surface of the forward portion and an annular boundary surface surrounding the mouth of the blind bore of the ballast body. This spring element forms a thick-walled pipe and entirely surrounds the pin and abuts against both of the front and rear boundary surfaces. The spring element is slightly sub-caliber; therefore there is present in the initial condition of the projectile a recess between both of the afore-mentioned boundary surfaces. The ballast body has a guide ring in its peripheral region.

As a result of the acceleration forces of the ballast body, which occur at firing, the rubber-elastic spring element is compressed, without the arrangement becoming over-caliber in the afore-mentioned region. As soon as the arrangement has exited from the gun barrel and no longer is under the direct influence of the propellant gases, the energy stored by the spring element is released. The ballast body is thereby slidably displaced, counter to the flight direction, on the pin towards its free end, the axial guiding is lifted, and the ballast body separates from the pin of the front portion.

Several sensitive drawbacks at the latest now appear, because the behavior of the ballast body is fully uncontrolled. In view of the fact that the ballast body separates shortly after emergence from the gun barrel from the remainder of the projectile, a dangerous condition in the vicinity of the muzzle of the gun barrel cannot be ruled out in this state of the art projectile. One only needs to observe the front portion with the rubber-elastic spring element surrounding the rearwardly extending pin. While it can not be disputed, that the mass of the remaining latter-mentioned arrangement is less than the total mass previously described, and also that the air resistance against the remaining arrangement changes as compared to that of the entire arrangement, one cannot forcibly conclude from this that a reduction of the range (of the remainder of arrangement) must occur. If finally a comparison is made between the position of the center of gravity of the mass of the entire arrangement and the position of the center of gravity of the remainder of the arrangement, then one is able to determine, that the center of gravity of the remainder of the arrangement is disposed along the longitudinal axis of the projecticle, as is the case with the center of gravity of the entire arrangement, substantially closer towards the forward end region thereof. This can lead to an overstabilization of the remainder of the arrangement and at least for the remainder of the arrangement the sought-after range reduction remains doubtful. Consequently, also the remainder of the arrangement behaves in an uncontrolled fashion at strong scattering so that also here at poor reproducability a significant risk may occur.

SUMMARY OF THE INVENTION

It is an object of this invention to provide a training projectile of the afore-described type which is simple to manufacture, has a ballastic behavior over a predetermined firing range corresponding to a predetermined flight path that corresponds substantially to that of a live reference projectile, but which maintains over the aimed for flight path an unchanged mass and a one piece integrity. Therefore a good reproducibility of the firing results with a good comparability relative to the conditions prevailing at firing with live reference ammunition is obtained.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
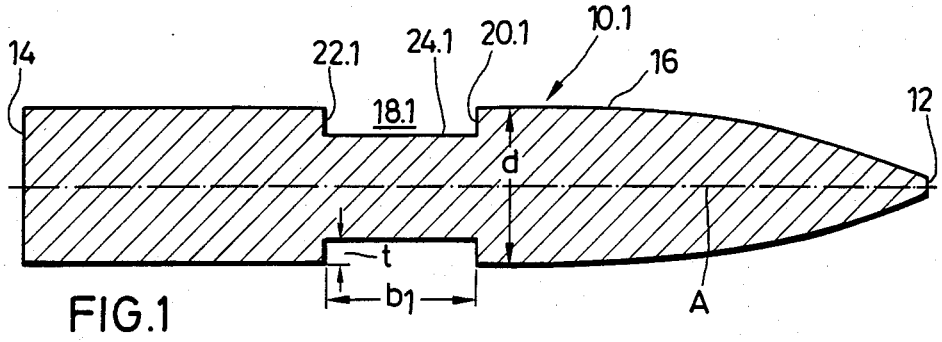
FIG. 1 is a schematic side-elevational view of a first embodiment of a training projectile of this invention having one recess, which view is in longitudinal axial section.

The various embodiments of this invention are illustrated schematically in the drawings. When reviewing the drawings further advantages may become apparent to those skilled in the art. Equivalent parts in the various embodiments are designated with the same reference numbers.

A training projectile 10.1, as illustrated in FIG. 1, has a point or nose 12, a tail surface 14 and a peripheral surface 16 extending along a central longitudinal axis A. This training projectile 10.1 has an annular recess 18.1. The projectile 10.1 is a full-caliber projectile having a caliber d. The annular recess 18.1 has a front annular surface 20.1 and a rear annular boundary surface 22.1 which are joined by a cylindrical base surface 24.1. The depth t of the annular recess 18.1 corresponds approximately to a fifth up to a fourth of the caliber d. The ratio of the depth t to the width $b_1$ of the annular recess 18.1 ranges between a minimum value of 0.1 to a maximum value of 0.5. The training projectile 10.1 is designed for gun barrel weapons having a rifled bore and a caliber of, for example, 155 mm. Such projectiles have a guide ring which has not been illustrated for purposes of simplicity and clarity.

Figure 2:
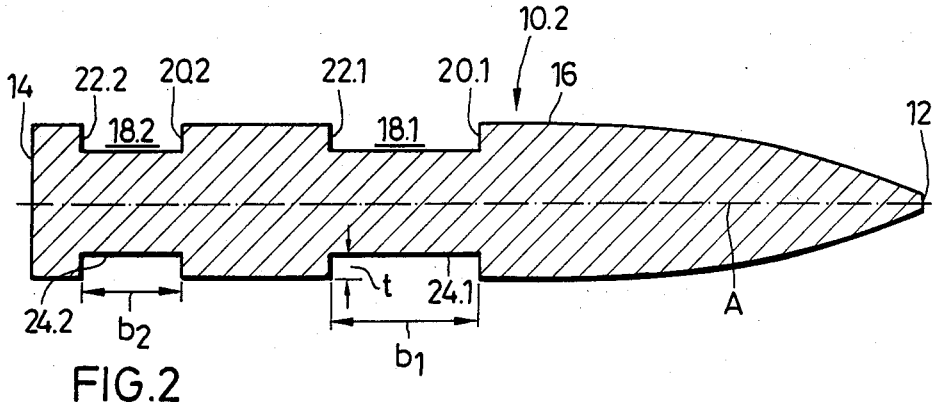
FIG. 2 is a view similar to that of FIG. 1 of a second embodiment having two recesses which view is also schematic and in longitudinal axial section.

The training projectile 10.2 of FIG. 2 substantially differentiates itself from that of FIG. 1 by providing a second annular recess 18.2 in the tail region of the corresponding training projectile. In the illustrated embodiment both annular recess 18.1 and 18.2 are of equal depth; the widths $b_1$ and $b_2$ are, however different from each other without exceeding or falling below the afore-mentioned limits of the value of the relationship t/d.

A long testing program carried out by the applicants has established the following:

The training projectiles of this invention have such ballastic characteristics that they may use firing tables that are valid for reference projectiles (live ammunition). In a predetermined region of the first portion of their flight path, which region is determined by the length of the flight path, the training projectile of this invention has its flight reduced in a reliable manner and its flight characteristics can be adapted in such a way to the flight path of a corresponding live reference projectile that the afore-described usage of the firing tables is possible. In this way it is possible to advantageously construct training projectiles in a realistic fashion even while strictly maintaining the safety measures designed for the permissible range and scattering. The simply constructed training projectile remains in one piece after firing. All variations of the training projectile of this invention can be visually distinguished from the reference projectile and when it is dark can be distinguished by tactile manipulations in the dark.

A variable training projectile has not been illustrated. It is, however, understood that a construction of modular elements is possible. In this connection reference is made to German Pat. No. 26 09 560 where such modular construction is described. If such modular construction techniques are used it would provide for a more flexible and therefore logistically advantageous manufacture of the training projectile of this invention.

I claim:

1. An improved full caliber, training projectile body of reduced range to be fired, said projectile body having at least one annular recess means coaxially arranged with respect to the longitudinal axis of the projectile body, the shape of said projectile body corresponds, with the exception of the annular recess means, to that of a conventional live reference ammunition unit of the same caliber as said projectile body; the improvement comprising said annular recess means in the projectile body having a radial depth t which is equal to about 1/5 to ¼ of the caliber of the training projectile;

each one of said annular recesses means having a width b, the ratio of the depth t to the width b of the annular recess means ranges between 0.1 to 0.5, so that the position of the center of gravity of the training projectile corresponds substantially to that of a conventional full caliber projectile;

whereby without influencing the spin of the training projectile a predetermined reduction in the range of the training projectile is achieved, and the air streaming conditions caused by said annular recess means during flight is such that a flat trajectory of the training projectile is achieved which substantially corresponds in its initial flight path to that of the live reference ammunition.

2. The improved full caliber, training projectile as set forth in claim 1, wherein said projectile body has a plurality of recesses of different cross-sections but equal radial depths.

* * * * *